United States Patent [19]

Spacer

[11] Patent Number: 4,484,865

[45] Date of Patent: Nov. 27, 1984

[54] FLUID PUMP FOR USE DOWN A WELL

[76] Inventor: John P. Spacer, Box 127, Sandia Park, N. Mex. 87047

[21] Appl. No.: 496,963

[22] Filed: May 23, 1983

[51] Int. Cl.[3] ..... F04B 47/08

[52] U.S. Cl. ..... 417/478; 417/480; 92/140

[58] Field of Search ..... 417/478, 479, 480, 474, 417/398; 92/92, 140

[56] References Cited

U.S. PATENT DOCUMENTS

| | | | |
|---|---|---|---|
| 3,075 | 2/1819 | Barron | 417/480 |
| 1,546,973 | 7/1925 | Ellis | 417/478 X |
| 1,965,006 | 7/1934 | Scott | 417/478 X |
| 2,829,500 | 4/1958 | Butler | 92/140 X |
| 3,020,846 | 2/1962 | Thomas | 417/478 |
| 3,427,987 | 2/1969 | Eull | 417/478 X |
| 3,440,970 | 4/1969 | Wagner | 92/92 X |

FOREIGN PATENT DOCUMENTS

| | | | |
|---|---|---|---|
| 598708 | 10/1959 | Italy | 417/478 |
| 636498 | 3/1962 | Italy | 417/479 |

OTHER PUBLICATIONS

Albo, R. T., Positive Displacement Pump, IBM Technical Disclosure Bulletin, vol. 7, No. 11, Apr., 1965.

*Primary Examiner*—Leonard E. Smith
*Attorney, Agent, or Firm*—Walter R. Keller

[57] ABSTRACT

A fluid pump for use down a well, having a pump shell, a flexible bladder, a squeeze plate, two check valves, and a plurality of toggle linkages, and a drive rod. The flexible bladder is positioned between the pump shell and the squeeze plate inside the pump shell, and the toggle linkages pivotally connect the squeeze plate, the drive rod, and the inside surface of the pump shell in a manner that permits with one complete stroke of the drive rod the compression and relaxing of the flexible bladder. The power source, is located at the surface of the earth.

5 Claims, 4 Drawing Figures

FLUID PUMP FOR USE DOWN A WELL

BRIEF SUMMARY

The invention is a simple, economical, completely submersed fluid pump for use down a well. Its greatest use would be for pumping water or other low viscosity fluids such as light oils. The pump is driven by a hydraulic source on the surface which receives its power from means such as wind, electricity, or solar radiation.

BACKGROUND

1. Field of the Invention.

This invention relates generally to fluid pumps, and more specifically to pumps used in wells.

2. Description of the Prior Art.

Many bladder or diaphram pumps have been designed in the past. The most pertinent to the present invention are M. J. Eull, U.S. Pat. No. 3,427,987; P. L. Scott, U.S. Pat No. 1,965,006; and W. E. Ellis, U.S. Pat. No. 1,546,973. Eull uses air pressure to collapse a bladder; while Scott uses a yoke. Ellis is somewhat different in principle using a bellows arrangement. In a down-the-well situation, Eull must have long lines which means that a lot of compressed air must be pumped. Scott is difficult to use because of the space constraints in well casings. Complexity in a down-the-well situation is very undesireable because it leads to maintenance problems.

DESCRIPTION OF THE PREFERED EMBODIMENT

Figure 1:
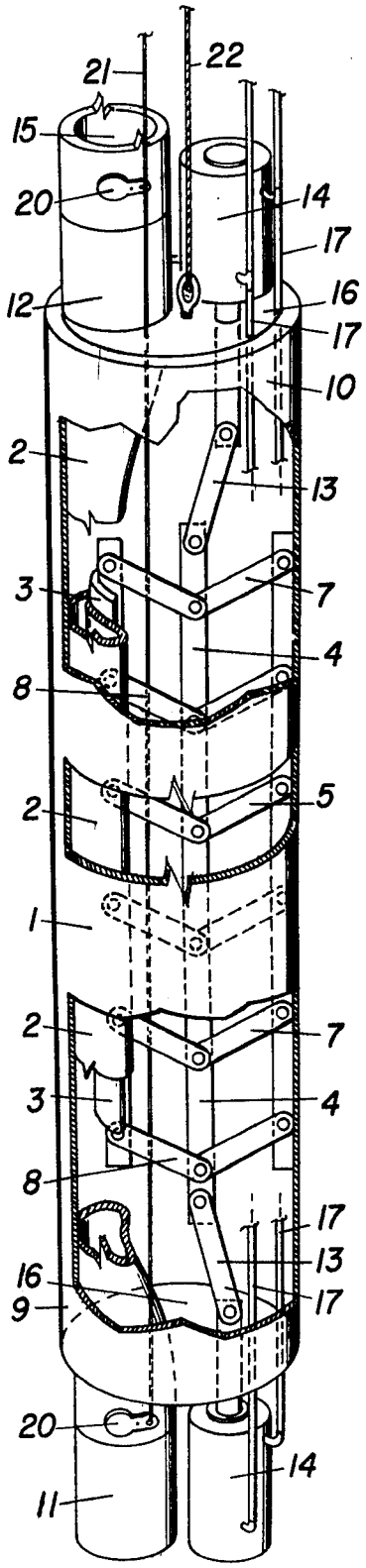
FIG. 1 is an isometric of the invention.
Figure 3:
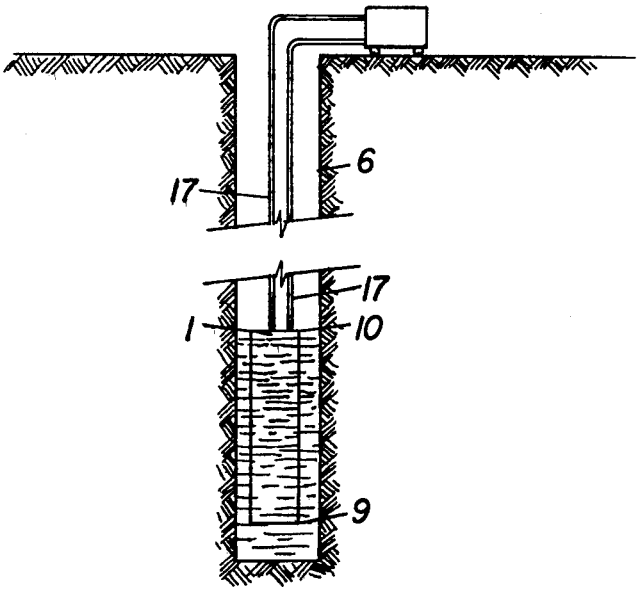
FIG. 3 is a cross sectional sketch of a well with the invention installed.

Refering to the drawings, FIG. 1 shows the invention to have a pump shell 1, a flexible bladder 2, an arcuate squeeze plate 3, and a plurality of toggle linkages 5. The pump shell 1 is cylindrical, and sized to be easily installed in a well casing 6, as shown in FIG. 3. The pump shell 1 is made of rigid material as required. The arcuate squeeze plate 3 is sized and curved to fit approximately the inside dimensions of the pump shell 1, but has an arcuate width approximately one quarter of the inside circumference of the pump shell 1. The flexible bladder 2 is made of any strong material which is resilient yet can be squeezed nearly flat. Material as is commonly used in fire hoses works well as a flexible bladder 2. The flexible bladder 2 is cylindrical hose shaped, with an outside diameter approximately half the inside diameter of the pump shell 1. The flexible bladder 2 is attached to the inside wall of the pump shell 1 and is also attached to the convex surface of the arcuate squeeze plate 3.

Each of the toggle linkages 5 are comprised of a rocker bar 7 and a push bar 8. The rocker bars 7 and the push bars 8 are rigid members. The rocker bars 7 is connected on one end in a pivotal manner to the inside of the pump shell 1. The push bars 8 are pivotally connected on one end to the concave surface of the arcuate squeeze plate 3. A drive rod 4 is situated under the concave surface of the arcuate squeeze plate 3 and runs the length of the invention. The other ends of the rocker bars 7 and the push bars 8 are pivotally connected to the drive rod 4. The rocker bars 7 and the push bars 8 are of approximately the same length, and the combined length of a rocker bar 7 and a push bar 8 is sufficient to displace the arcuate squeeze plate 3 against the flexible bladder 2 and squeeze the flexible bladder 2 so that the internal volume of the flexible bladder 2 is nearly zero.

The invention has a down well end 9 and an up well end 10. Each end of the flexible bladder 2 is connected to a one direction fluid check valve; the check valve on the down well end 9 is designated as 11, and the check valve on the up well end 10 is designated 12. The check valves 11 and 12 are oriented to permit fluid to enter the flexible bladder 2 at the down well end 9 and to permit fluid to exit the flexible bladder 2 only at the up well end 10. The up well 10 check valve 12 is connected to pipe 15 which leads directly to the surface.

Figure 2:
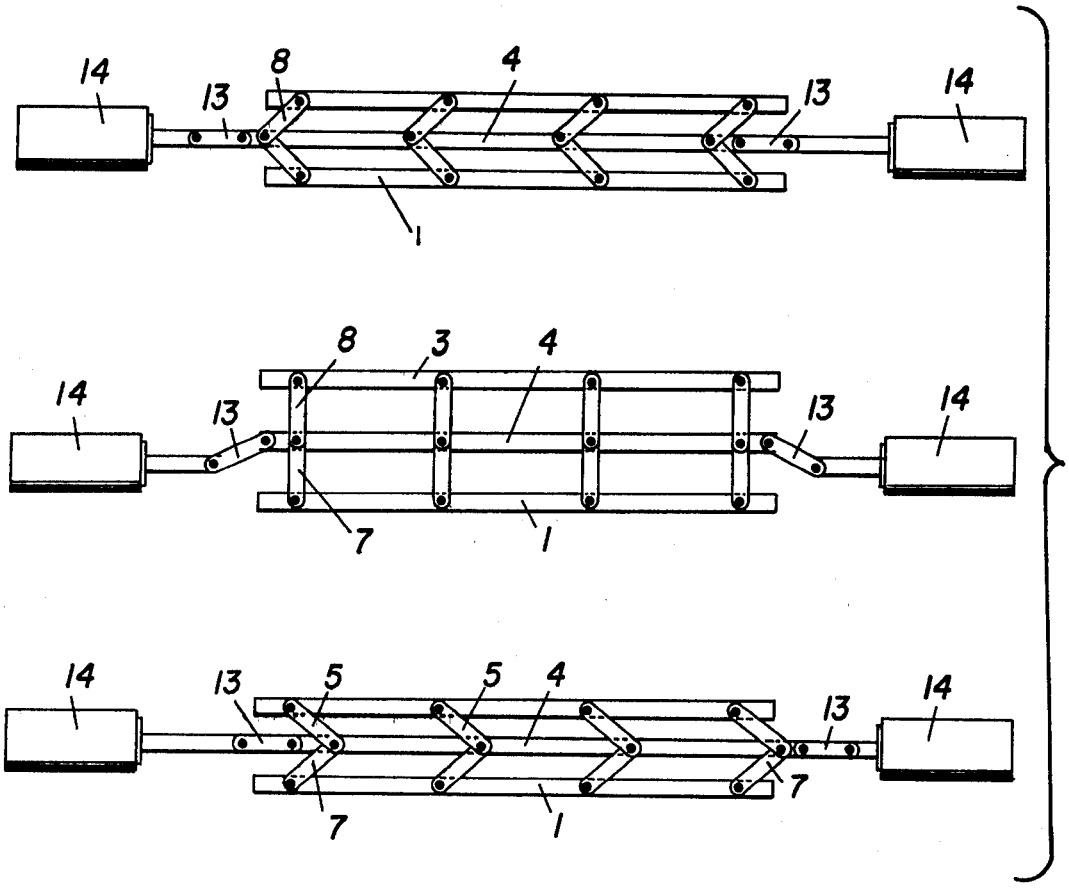
FIG. 2 is a diagram showing the motion of the toggles and the drive rod.

As shown in FIG. 1, the drive rod 4 is connected, pivotally, to a clevis bar 13, which in turn is connected to a hydraulic cylinder 14. The pivotal connections between the clevis bar 13 and the hydraulic cylinder 14 and between the clevis bar 13 and the drive rod 4, accomodate the non-linear motion of the drive rod 4. Alternatively, a clevis can be attached to the rear of each hydraulic cylinder 14. In this mode the hydraulic cylinder 14 would be pivotally affixed to the end plates to accomodate the non-linear motion of the drive rod 4. As shown in FIG. 2, the drive rod 4 is initially forced from a down well 9 position towards the upwell direction. As the drive rod 4 is forced in the up well 10 direction, the rocker bars 7 rotate about their pivotal connection to the pump shell 1, and the drive rod 4 is forced toward the center line of the pump shell 1. Simultaneously, the push rods 8 push the arcuate squeeze plate 3 against the flexible bladder 2. As the drive rod 4 is forced further in the up well 10 direction, the rocker bars 7 and the push bars 8 will become diametrically opposed and perpendicular to the drive rod 4. This position is the point at which the arcuate squeeze plate 3 exerts maximum compression on the flexible bladder 2. As the drive rod 4 is forced even further in the up well direction 10, the rocker bars 7 and the push bars 8 are inclined towards the drive rod 4, thus expanding the flexible bladder 2, reducing the pressure therein and causing the flexible bladder 2 to be filled with fluid through check valve 11. Upon reaching the limit of travel of the hydraulic cylinders 14, the hydraulic cylinders 14 reverse their directions and drive the drive rod 4 in the down well 9 direction. In its down well 9 movement the drive rod 4 will again first compress the flexible bladder 2, then expand it. While only one double acting hydraulic cylinder 14 would be enough, it is shown in FIG. 1 that there are two double acting hydraulic cylinders 14, one at each end of the drive rod 4. Indeed, it is also contemplated that a single double acting hydraulic cylinder 14 could be placed at the approximate mid-point of the drive rod 4 and accomplish the necessary movement of the drive rod 4. The hydraulic cylinders 14 are actuated by hydraulic pressure generated on the surface and piped to the hydraulic cylinders 14 by hydraulic lines 17. The hydraulic pressures can be generated on the surface by wind power, electric power, or by solar power.

Finally the invention has two end caps 16. On the end caps 16 are mounted the hydraulic cylinders 14, and the check valves 11 and 12. Through the end caps the hydraulic lines 17, and the pipe 15 to the surface must pass through appropriate orifices.

Figure 4:
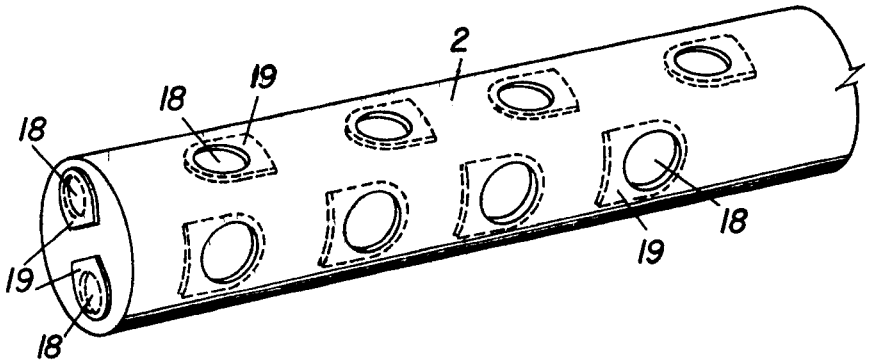
FIG. 4 is an isometric of an alternate configuration of the bladder.

An alternate configuration of the flexible bladder 2 is shown in FIG. 4. The flexible bladder 2 is shown to have a multiplicity of holes, or slots, 18 through which fluid under normal hydrostatic pressure may flow and fill the flexible bladder 2. On the inside of the flexible bladder 2, the holes 18 therein are covered with flexible yet resilient flapper valves 19; so that as the arcuate squeeze plate 3 presses against the flexible bladder 2, the increased pressure therein closes the flapper valves 19 and the fluid can only escape through the up well 10 check valve 12. Of course it would also be necessary to permit fluid to enter the pump shell 1, and therefore the pump shell 1 in this alternative configuration, also has a multiplicity of holes or slots, not shown. This alternative configuration eliminates the need for the down well 9 check valve 11, and permits the down well 9 end of the flexible bladder 2 to be sealed. It also allows the bladder 2 to fill quicker enabling faster pumping.

FIG. 1 also shows a means for dumping the fluid in the pump and the fluid in the pipe 15 to the surface. This is done to reduce the weight when pulling the pump from the well for repairs and maintenance. This means for dumping the fluid is optional. Spring loaded dump valves 20 are installed up well 10 from each check valve 11 and 12. The dump valves 20 are actuated by a trip line 21 from the dump valves 20 to the surface. While actuated, the dump valves 20 allow the fluid in the system to drain down into the well. Having been actuated, the dump valves 20 are automatically reset once the trip line 21 is released. To facilitate the pulling of the pump from the well, a hoisting cable 22 is shown in FIG. 1 as being attached to the up well 10 end cap 16. The hoisting cable 22 leads to the surface where it can be attached to a means for lifting such as a winch, not shown.

Other modifications to the invention as described such as but not limited to an expanding mean inside the flexible bladder 2 to assist in fully expanding the flexible bladder 2 are contemplated, and it is obvious that given sufficient depth of fluid in the bottom of the well, identical pump units could be connected in fluid circuitry, parallel or series, and with interconnected drive rods 4 so that more than one pump unit could be used in a well.

I claim:

1. A fluid pump for use down a well casing comprising:

a pump shell sized to slide inside a well casing, and a flexible bladder approximately half the inside diameter of the pump shell, and an arcuate squeeze plate whose arcuate width is approximately one quarter of the inside circumference of the pump shell, and a drive rod, and a plurality of toggle linkages, wherein each toggle linkage is comprised of a rocker bar and a push bar, and wherein the flexible bladder is attached on one side to the pump shell inner surface, and wherein the flexible bladder is attached on its other side to the convex surface of the arcuate squeeze plate, and wherein each rocker bar is pivotally connected on one end to the inner surface of the pump shell diametrically opposite to where the flexible bladder is attached to the pump shell, and wherein the other end of the rocker bar is pivotally attached to the drive rod, and wherein each push bar is pivotally attached to the drive rod on one end, and the other end of each push bar is pivotally attached to the concave surface of the arcuate squeeze plate, and wherein the combined length of the push bar and the rocker bar is such as to sufficiently squeeze the flexible bladder against the pump shell, and two one way fluid check valves, each connected to one end of the flexible bladder, and oriented so that one check valve permits fluid to enter the flexible bladder, while the other check valve only permits fluid to leave the flexible bladder, and a clevis being pivotally connected on one end of the drive rod and on the other end to a means for providing power to the drive rod, and said means including hydraulic cylinders two end caps which are mounts for the check valves and hydraulic cylinders and through which fluid may pass into the flexible bladder through one of the check valves, and through which the hydraulic lines and the line to the surface for the pumped fluid may pass.

2. The fluid pump of claim 1 wherein the means for providing power to the drive rod comprises hydraulic lines from a hydraulic pump on the surface down the well casing to hydraulic cylinders mounted on the end caps, and the being pivotally connected to the clevis on the end of the drive rod.

3. The fluid pump of claim 1 wherein the flexible bladder has a plurality of feed holes, and the pump shell has a plurality of feed holes, and wherein each feed hole in the flexible bladder has, on the inside of the flexible bladder, a flapper valve attached to the inside of the flexible bladder, such that fluid can enter the bladder, but the pressure inside the bladder being raised closes the flapper valves over the feed holes in the flexible bladder.

4. The fluid pump of claim 1 having a means for dumping the fluid in the pump before raising the pump from a well, said means for dumping the fluid in the pump comprises a dump valve upwell from the check valve at both ends of the pump, said dump valve being actuated by a trip line connected to each dump valve and said trip line running to the surface.

5. The fluid pump of claim 1 having a means for raising the pump from the well, wherein the means for raising the pump from the well comprises a hoisting cable affixed to the up well end cap, and said hoisting cable running to the surface where it may be attached to a winch.

* * * * *